United States Patent [19]

Goenner

[11] Patent Number: 5,052,452

[45] Date of Patent: Oct. 1, 1991

[54] METHOD FOR PROCESSING SQUARED TIMBER

[75] Inventor: Siegmar Goenner, Oberkirch, Fed. Rep. of Germany

[73] Assignee: Firma Gebruder Linck Maschinenfabrik "Gatterlinck" GmbH & Co. KG, Oberkirch, Fed. Rep. of Germany

[21] Appl. No.: 609,167

[22] Filed: Nov. 1, 1990

[30] Foreign Application Priority Data

Nov. 1, 1989 [DE] Fed. Rep. of Germany ..... 3936313
Aug. 21, 1990 [DE] Fed. Rep. of Germany ..... 4026346

[51] Int. Cl.[5] ..... B27L 9/00; B27B 1/00

[52] U.S. Cl. ..... 144/3 P; 83/365; 83/368; 144/120; 144/184; 144/245 A; 144/249 A; 144/357; 364/474.13

[58] Field of Search ..... 144/3 P, 120, 155, 159, 144/182, 184, 175, 357, 369, 242 R, 245 R, 245 A, 246 R, 249 A; 83/365, 368; 364/474.09, 474.13, 474.15, 478; 356/376, 381, 384, 385; 198/624, 836

[56] References Cited

U.S. PATENT DOCUMENTS

| | | | |
|---|---|---|---|
| 4,589,456 | 5/1986 | Traben | 144/184 |
| 4,825,917 | 5/1989 | Gonner | 144/184 |
| 4,879,659 | 11/1989 | Bowlin et al. | 144/357 |
| 4,941,100 | 7/1990 | McFarlane et al. | 144/357 |

*Primary Examiner*—W. Donald Bray
*Attorney, Agent, or Firm*—Marshall, O'Toole, Gerstein, Murray & Bicknell

[57] ABSTRACT

A method wherein a length of squared timber can be completely separated into a number of thin boards having a predetermined thickness without an excessively thin or excessively thick unusable residual board being left over is disclosed. The method includes measuring the thickness of the residual squared timber after one or more thin boards have been separated, and feeding the thickness measurement back to the cutting apparatus to adjust the setting of the apparatus. The method is useful on an apparatus that separates a length of squared timber into thin boards without producing chips and without timber loss, and wherein the predetermined board thickness cannot be set exactly because of variations in the property parameters of the wood.

8 Claims, 1 Drawing Sheet

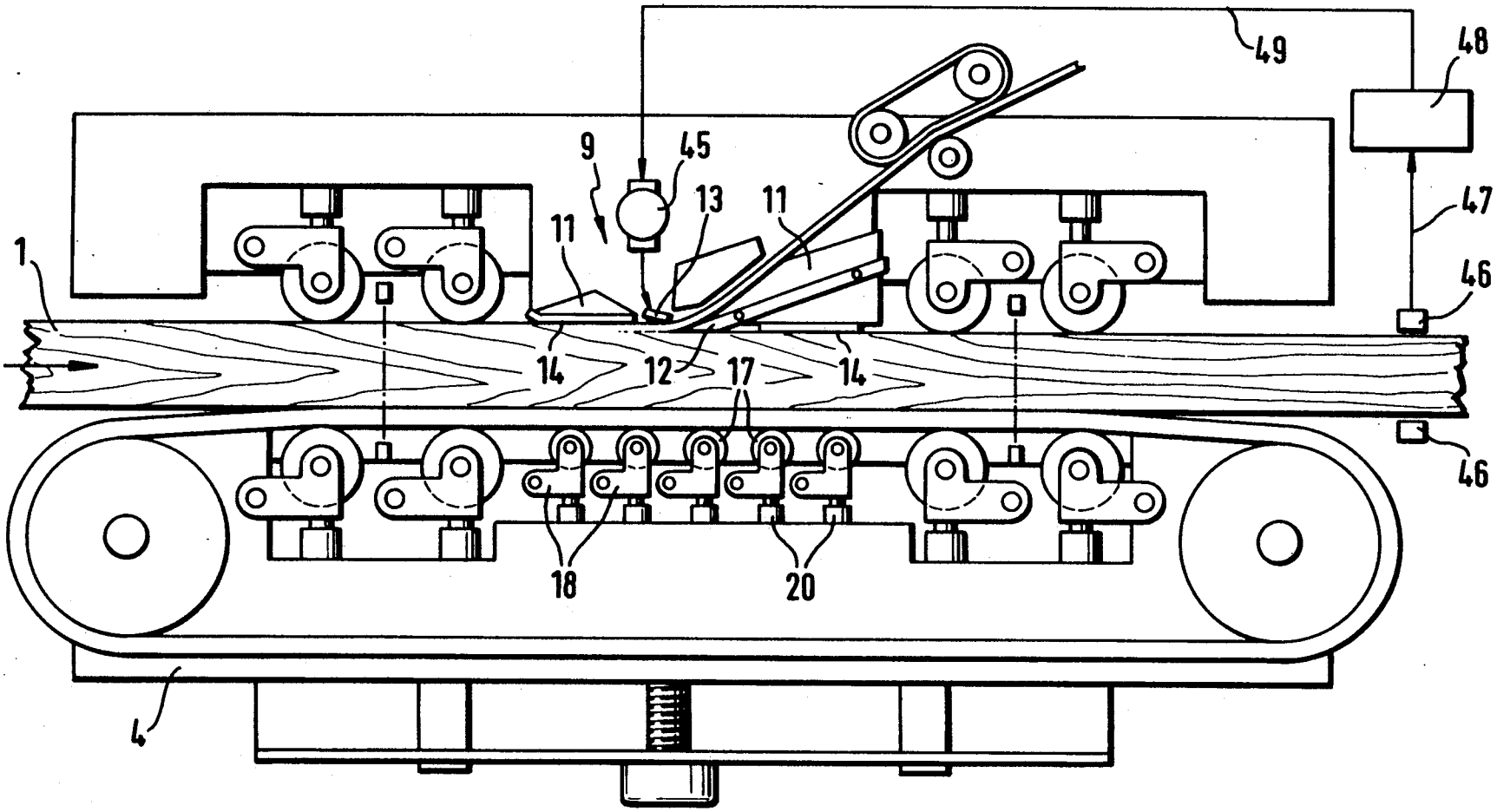
48
47
46
46
49
45
13
11
9
11
14
14
12
17
20
18
1
4

METHOD FOR PROCESSING SQUARED TIMBER

The invention relates to a method of processing squared timber by chipless and waste-free separation of the squared timber to yield a preset number of thin boards having a predetermined thickness, and without timber loss in the form of an unusable residual board. More particularly, the invention relates to a method for the chipfree and waste-free separation of a piece of squared timber into a preset number of thin boards having a predetermined thickness sequence, and for the production of multi-ply composite sheets and other laminated components, wherein thin boards are produced in sequence by pressing the squared timber in the transverse direction by a loading means against a knife or blade and a cooperating thrust element, by moving the squared timber in the longitudinal direction thereof towards the knife, and by using the action of the knife or blade and the cooperating thrust element to separate a thin board from the squared timber. The distance between the knife and the cooperating thrust element, in a direction transverse in relation to the longitudinal direction of the squared timber, substantially determines the thickness of the thin board produced; and the distance between the knife and the loading means, transversely in relation to the longitudinal direction of the squared timber during the separation of a thin board, substantially corresponds to the thickness of the squared timber less the thickness of the thin board to be separated.

It is conventional in the art to produce high-strength wood components, for example the trusses or beams in wooden buildings and the like, as laminated components by bonding a multiplicity of lamellae or thin boards together as a multi-ply structure, and if appropriate, alternating the ply grain direction from one ply to the next.

Normally, the thin lamellar boards required for such uses are produced by dividing squared timber in a sawing operation. This sawing method is uneconomical with respect to the full use of timber, because in the production of thin boards, which are often required, up to 40% of the wood is lost in the form of sawdust. It is a relatively simple matter to divide squared timber into boards of equal thickness, if the breadth of the gap formed by sawing (which is dependent on the type of saw blade used) is taken into account. If, for instance, ten thin boards of the same thickness are to be produced from one piece of squared timber, the thickness of each thin board will be equal to one tenth of the thickness of the squared timber minus nine times the breadth of the saw cut. By selecting squared timber with a certain thickness and by suitable adjustment of the saw blades, it then is possible to produce thin boards with a predetermined, equal thickness. Then in the case of laminated components, whose boards in the form of plies are bonded together, it is necessary for certain tolerances to be observed for the thickness of the thin boards.

Recently, in order to make better use of valuable wood as a raw material, the practice of using a knife or blade to separate lamellar boards from squared timber in a chipless manner has been adopted, as opposed to cutting by using a saw. For example, see German Patent Publication DE-OS 87 02 909A or the corresponding U.S. Pat. No. 4,825,917, incorporated herein by reference. In the method described therein, the squared timber generally is fed in its longitudinal direction towards and against a stationary knife. Positioned ahead of the knife is a cooperating thrust element that precludes the otherwise normally-occurring splitting of the wood, with such splitting starting at the gap between the knife and the cooperating element due to the action of the knife. In a direction transverse to its longitudinal direction, the squared timber is pressed by a loading means against the knife and the cooperating thrust element.

The parameter that roughly determines the thickness of a thin board so produced is the distance, or gap, between the knife and the cooperating thrust element in a direction perpendicular to the transverse axis of the squared timber. The actual thickness of the thin board however is dependent on a number of further parameters, namely for instance, the moisture content of the wood, or the thrust of the cooperating thrust element on the squared timber, possibly independently of the knife, and the like. German Patent Publication DE-OS 36 23 237A describes some of these further parameters.

Attempts already have been made to account for such parameters, and to make appropriate adjustments when setting the distance between the knife and the cooperating thrust element, and when setting the thrust exerted by the cooperating thrust element, in order to obtain thin boards having a predetermined thickness. However, since wood is a natural product and therefore varies in its properties, many of the parameters cannot be taken into sufficient account to preset the thickness of the thin board produced. Despite intensive activities, no practical way of precisely controlling the thin board thickness on the basis of the above parameters is known.

It is known that in a continuous process to provide thin boards having a uniform thickness, the variation in thickness of a plurality of thin boards produced from squared timber is cumulative. Therefore, although the thickness deviation of a single thin board may be tolerable with respect to that board, even slight deviations in board thickness between individual thin boards ultimately leads to a sufficient error that there will be a residual board having a thickness so different from the predetermined thickness that the residual board is unusable. Accordingly, one object of the present invention is to provide a method wherein a preset number of thin boards of a predetermined thickness can be produced from a piece of squared timber, with the thin boards having an expressly preselected thickness, by cutting division, without generating a residual board at the end of the cutting process that has such an odd thickness that is unusable.

Therefore, in accordance with the present invention, the previously-described method of dividing square timber into thin boards is modified in that, first, a starting piece of squared timber is selected such that its initial thickness is equal to the sum of the thicknesses of the thin boards to be produced. Then, the distance between the knife and the cooperating thrust element is set to a value that leads to the production of a first thin board having the desired predetermined thickness. After the separation of one or more thin boards from the squared timber, the thickness of the residual squared timber then is measured, and the setting of the apparatus, and more particularly the distance between the knife and the cooperating thrust element, is modified in response to the thickness measurement of the residual squared timber. Accordingly, thin boards with a correct predetermined thickness are produced and no waste timber results. In addition, after each thin board is separated from the squared timber, the loading means is moved an amount corresponding to the original predetermined thickness of the thin boards prior to the separation of the next thin board from the squared timber by the knife and the loading thrust.

It has been demonstrated that the thickness of an individual thin board can be predicted with a sufficient degree of accuracy by a suitable presetting of the cutting apparatus such that all the thin boards are usable in further processing. It is, in fact, an algebraic sum of the deviations in thin board thickness that, although still tolerable in the case of a single thin board, is responsible for the residual board being unusable when the squared timber is completely cut. In accordance with the present invention, the measurement of the residual squared timber, and the feedback of this measurement to adjust the setting the thrust element or the knife for the separation of the next thin board, provide an extremely simple way of separating squared timber into thin boards without complex acquirement of control parameter data, and of controlling the cutting process to obtain thin boards of a predetermined thickness without waste.

In accordance with a preferred form of the present invention, the method can produce a series of thin boards from a given piece of squared timber, wherein the thin boards have a different thickness, without however leaving a residual board that cannot be used in further processing. This particular embodiment of the present method is highly significant in the production of laminates from cut thin boards.

The production of composite laminate sheeting and other components makes it necessary to use thin boards that have a certain minimum moisture content because the thin boards are bonded together. A minimum moisture content is necessary because on one hand there is a chance of difficulties even while not pressing the laminated products, and on the other hand there may be difficulties during further processing. In the case of conventional methods of producing laminates, wherein the thin boards are produced by cutting with saw cuts from a piece of squared timber, the general practice has been to use sufficiently dried squared timber for the production of the thin boards, which then are suitable for direct further processing without undergoing any further treatments. In the case of producing thin boards by wasteless cutting, thin boards with a high quality surface can be produced only from moist wood. Therefore, it is necessary to dry these thin boards prior to further processing to form laminated products.

As is known, drying thin boards involves shrinkage. Shrinkage is anisotropic owing to the natural growth structure of the wood. In the cross direction of the trunk, the wood shrinks along the annual rings to a greater extent than athwart such rings. In the case of thin boards produced from squared timber, those thin boards that originate from the middle of the trunk extend substantially perpendicularly to the surface of the boards, the angle between the direction of the annual rings and the board surface decreases in size with the distance of the board from the center of the trunk. The result is that the thin boards from the trunk center undergo a greater shrinkage in thickness during drying than thin boards from the edge part of a trunk.

Accordingly, a primary aim in the production of laminates is to have available thin boards of equal thickness after drying. This can be achieved by oversizing the thickness of the thin board by an amount dependent on the original setting of the board wood in the squared timber, such allowance being made directly during cutting, and by compensating for the differential shrinkage of the boards during the process of drying. Then, after drying, boards of essentially the same thickness are obtained.

In the context of cutting the thin boards, this means that the distance between the knife and the cooperating thrust element, which essentially determines the thin board thickness, is varied with respect to the distance setting for the predetermined thickness of the thin board. When measuring the thickness of the residual squared timber, the actual thickness value of the residual squared timber may differ from the expected thickness value of the residual squared timber after the separation of one or more thin boards therefrom. Then, in the case of thin boards with the same thickness, this thickness differential is divided by the number of thin boards still to be produced from the residual squared timber in order to arrive at a correction value for each thin board. Accordingly, the distance between the knife and the cooperating thrust element is corrected in relation to the predetermined distance setting, which otherwise remains constant in the case of production of thin boards having the same thickness.

If it is desired to produce a series of thin boards with different thicknesses, it is necessary for the differential in the thickness of the residual piece of squared timber from the expected thickness value to be divided by the number of thin boards still to be produced in a manner proportional to the respective thickness thereof. Such an allotment of the thickness deviation among the individual boards is readily possible using modern data processing equipment. In the production of thin boards having different thicknesses, the distance between the knife and the cooperating thrust element in any case is altered for each cut. Therefore, it is possible to simultaneously take into account a respective computer-calculated correction value as well.

The deviations in thin board thickness arising from the different shrinkage behavior of the thin boards are comparatively small, and furthermore the correction values to be taken into account after measurement of the residual squared timber are also small. Therefore, the method also can be used in the production of thin boards of different thickness in such a manner that the thickness deviation found in the case of the residual squared timber is divided by the number of the thin boards to be produced in order to allot the same correction value to each board. Errors involved in such a correction value in any case are compensated for by feedback the next time the thickness of the residual squared timber is measured.

The thickness measurement of the residual squared timber after the separation of one or more thin boards can be performed in different ways, for example by mechanical sensing using a suitable thickness sensing device or by optical measurement. In this respect, it is advantageous to ensure that the thickness measurement is performed such that the area of residual squared timber measured is as representative as possible, and that the measurement result is not erroneous due to individual proud fibers or random depressions in the wood. The measurement can be performed by placing the arms of a veneer caliper on the two sides of the residual squared timber. In the case of optical measuring methods, for instance using a laser beam, automatic evaluation of the scanning curve can be used to obtain the same result.

For a further optimization of the scanning or measuring method, a detecting and evaluating unit can be coupled, either electronically or mechanically, with the respective moving elements of the cutting apparatus such that the adjustment of the distance between the knife and the thrust element is performed automatically by the detecting and evaluating unit.

If the cutting apparatus producing the thin boards is equipped only with a single knife or blade, and if the squared timber is divided by repeated passes through the cutting apparatus so that the squared timber ultimately is completely converted into thin boards, it may be advantageous to measure the thickness of the residual squared timber each time it passes through the apparatus. If however two or more machines, each provided with a blade, are used, through which the squared timber to be divided passes in succession, then it can be advantageous for the purpose of reducing capital investment to perform the thickness measurement of the residual squared timber only after one pass through a series of cutting means. This will depend on the accuracy of measurement possible with the equipment. The same conditions may apply if one cutting device is provided with a plurality of knives arranged in series, so that in one pass through the cutting apparatus, a series of thin boards is produced.

It is to be emphasized that an advantage of the present method is the complete separation of a piece of squared timber to produce usable thin boards, wherein it is unnecessary to measure raw material parameters that are specific to the squared timber at hand, and in some cases change from one trunk of squared timber to the next, in order to obtain the predetermined thin board thickness. It is only necessary to feed back the thickness measurement of the residual squared timber in order to adjust the distance between the knife and the cooperating thrust element to provide thin boards having the correct predetermined thickness. Since the correction values are small in size, the loading means that thrusts the squared timber against the knife and against the cooperating thrust element is not influenced by the adjustments. The squared timber can be fed in accordance with the desired predetermined decrease in the thickness in previous steps each time the squared timber passes through the machine. The thrust exerted by the loading device on the squared timber is in any case produced by pneumatic or hydraulic cylinders arranged on the adjustable loading device, with such cylinders being able to adjust to a certain amount of play in the departure in the thickness of the squared timber.

The present method accounts for the differential shrinkage in thickness of the thin boards in accordance with their settings in the trunk, during cutting the thin boards from squared timber, because the thin boards can be cut to different thickness to compensate for the different amounts of shrinkage. This is regarded as an important feature of the present invention. If thin boards are cut from a central piece of squared timber that contains the pith of the tree in the center, then the thin boards to be cut require an increase in thickness starting from the outer side of the trunk towards the center of the trunk, and then a decrease again after separation of the middle thin board which contains the pith of the trunk therein. Using known process control equipment, it is possible to automatically feed such stipulated values to the cutting apparatus such that its cutting setting is adjusted accordingly.

The invention is described in greater detail based upon an embodiment illustrated in the attached drawing. In this context, explicit reference is made to the apparatus for cutting thin boards illustrated in FIG. 1 of U.S. Pat. No. 4,825,917 and to the associated parts of the description. Reference numerals given in the U.S. Pat. No. 4,825,917 are identically used in the present disclosure.

For better representation, a cutting station 9 having only a single blade 12 and an oppositely disposed pressure unit 10 is shown, said pressure unit 10 comprising a frame section 4 and a plurality of pressure rollers 17 that are controlled by means of pressure cylinders 20 via swinging levers 18. The squared timber 1 is repeatedly passed through the apparatus until the squared timber is cut completely into thin boards 15.

Of special importance is a blade holder 11, a blade 12, a thrust element in the form of a pressure rail 13 that is located ahead of the blade 12, and guide surfaces 14 that are positioned on blade holder 11. The pressure rail 13 is movable with respect to the blade holder 11 and the blade 12. The pressure rail 13 is joined with a feeding element 45, e.g. in a mechanical or electromotive manner. The feeding element 45 acts between the pressure rail 13 and the knife holder 11. In an alternative embodiment, the knife holder 11 and the pressure rail 13 can be independently mounted in the frame of cutting station 9.

Connected in series to the feeding element 45 is a sensing or measuring means 46, shown schematically in the attached drawing. The sensing or measuring means 46 can be a mechanical thickness sensing means, like a sliding caliper, or an optical measuring means, like a laser beam. The sensing or measuring means 46 is operatively connected to a detecting and evaluating unit 48 by a signal line 47. The detecting and evaluating unit 48 is operatively connected to the feeding element 45 for the pressure rail 13, either electronically or mechanically, by line 49.

The residual squared timber 1 exiting the cutting station 9 is measured mechanically or optically by means of the sensing or measuring unit 46, and the measuring results are signalled to the detecting and evaluating unit 48 through line 47. The detecting and evaluating unit 48 calculates from the values received from the sensing or measuring unit 46, the feeding value for the blade holder 11 and the pressure rail 13, respectively, and passes this feeding value on to the feeding element 45 that feeds the squared timber. Accordingly, a measuring of the residual squared timber can be effected, if desired, after each passage through the cutting station 9.

By measuring the thickness of the residual squared timber 1, and the feedback of the thickness measurement to adjust the pressure rail 13 for the separation of the next thin board, the dividing of a squared timber 1 into a preset number of usable thin boards of a desired predetermined thickness is obtained in the most simple manner, without a complicated detection or a control of process parameters.

I claim:

1. A method of separating a squared timber into a preset number of thin boards having a predetermined thickness, wherein a blade and a cooperating thrust element cut a thin board of the predetermined thickness from said squared timber by advancing said squared timber in a longitudinal direction toward the blade, and by pressing the squared timber in a direction transverse to the longitudinal direction of the squared timber against the blade and the cooperating thrust element by loading means wherein the distance between the blade and the cooperating thrust element in said transverse direction substantially determines the thickness of the thin board, and wherein said transverse distance between the blade and the loading means during the separation of the thin board from the squared timber substantially corresponds to the thickness of the squared timber less the predetermined thickness of the thin board, said method comprising the steps of:

a) setting a distance between the blade and the cooperating thrust element equal to an amount calculated to provide a thin board having the predetermined thickness;

b) advancing a squared timber having an initial thickness equal to a sum of the thicknesses of the total number of thin boards to be produced from the squared timber across the blade to separate one or more first thin boards from the squared timber and to generate a residual squared timber;

c) measuring a thickness of the residual squared timber;

d) adjusting the distance between the blade and the cooperating thrust element in response to a measured thickness of the residual squared timber to provide a corrected thickness for one or more second thin boards to be separated from the residual squared timber, said corrected thickness being equal to the thickness of the residual squared timber divided by the number of thin boards remaining to be separated from the residual squared timber; and e) moving said loading means for engaging the residual squared timber with the blade and the cooperating thrust element in an amount corresponding to the predetermined thicknesses of successive thin boards to be separated from the residual squared timber.

2. The method of claim 1 wherein the squared timber is separated into a preset number of thin boards having different predetermined thicknesses wherein, after the thickness of the residual squared timber is measured, the thickness of the residual squared timber is compared to an expected residual thickness, then a corrected thickness for the thin boards to be separated from the residual squared timber is computed and the distance between the blade and the cooperating thrust element is adjusted such that thin boards having a corrected thickness are separated from the residual squared timber.

3. The method of claim 2 wherein a deviation in the thickness of the residual squared timber from the expected thickness of the residual squared timber is divided by the number of the thin boards to be separated from the residual squared timber less one, said deviation in thickness being determined after each thin board is separated from the residual squared timber and said deviation in thickness is correlated to a setting of the distance between the knife and the cooperating thrust element.

4. The method of claim 1 wherein the thickness of the residual squared timber is measured by a mechanical measuring device.

5. The method of claim 1 wherein the thickness of the residual squared timber is measured by an optical measuring device.

6. The method of claim 5 wherein the optical measuring device comprises a laser.

7. The method of claim 1 wherein the thickness measurement of the residual squared timber is computed by an electronic processing unit to provide an average thickness measurement, said average thickness measurement of the residual squared timber being used to provide a corrected thickness sequence for the thin boards remaining to be separated from the residual squared timber.

8. The method of claim 1 wherein the predetermined thicknesses of the thin boards are correlated to a moisture content of the squared timber, such that after the thin boards are separated from the squared timber and dried, the thin boards have essentially the same thickness.

* * * * *